US005895536A

United States Patent [19]

Starr et al.

[11] Patent Number: 5,895,536

[45] Date of Patent: Apr. 20, 1999

[54] METHOD OF ADHERING ROOF TILES USING ONE-COMPONENT ADHESIVE AND ROOF CONSTRUCTION OBTAINED THEREBY

[75] Inventors: Cris Damon Starr, Cape Coral, Fla.; Gary Grunauer, Highland, Ind.

[73] Assignee: Insta-Foam Products, Joliet, Ill.

[21] Appl. No.: 08/649,450

[22] Filed: May 17, 1996

[51] Int. Cl.[6] ..... E04D 1/00; E04D 1/34

[52] U.S. Cl. ..... 156/71; 52/535; 52/543; 156/291

[58] Field of Search ..... 156/71, 77, 78, 156/79, 291; 52/748.1, 540, 543, 518, 535

[56] References Cited

U.S. PATENT DOCUMENTS

| | | | |
|---|---|---|---|
| 2,424,410 | 7/1947 | Miles . | |
| 2,667,131 | 1/1954 | Clarvoe | 156/71 |
| 3,042,193 | 7/1962 | Wendt . | |
| 3,050,908 | 8/1962 | Schenk . | |
| 3,080,683 | 3/1963 | Sallie | 156/71 |
| 3,180,783 | 4/1965 | Walker et al. . | |
| 3,252,257 | 5/1966 | Price | 156/71 |
| 3,511,007 | 5/1970 | Babcock . | |
| 4,036,673 | 7/1977 | Murphy | 156/79 |
| 4,314,433 | 2/1982 | Hulcombe . | |
| 5,099,627 | 3/1992 | Coulton | 52/748.1 |
| 5,165,210 | 11/1992 | Partyka et al. . | |
| 5,362,342 | 11/1994 | Murray et al. | 156/71 |
| 5,441,583 | 8/1995 | Eaton et al. . | |
| 5,494,228 | 2/1996 | Eaton et al. . | |

OTHER PUBLICATIONS

OSI Pro–Series Technical Data "RT–600 Roof Tile Adhesive", Jan. 1993.

"Polyset—Professional Tile Roofing System" Polyfoam Products, Inc., Jul. 1995.

"The New Fastener"—Insta–Stik Product brochure, Insta–Foam Products, Inc., Oct. 1993.

Insta–Stik "Spec Data", Insta–Foam Products, Inc., Nov. 1995.

*Primary Examiner*—Daniel Stemmer

*Attorney, Agent, or Firm*—Vedder Price Kaufman & Kammholz

[57] ABSTRACT

A method of adhering roof tiles to a roof utilizes a one-component adhesive and in particular, a one-component polyurethane adhesive foam applied to the undersurfaces of the roof tiles in a discontinuous patterns. The adhesive is applied in the form of separate deposits at opposing corners of the undersurfaces of the roof tiles and the roof tiles are laid on the roof in serial fashion and overlapping courses.

35 Claims, 3 Drawing Sheets

METHOD OF ADHERING ROOF TILES USING ONE-COMPONENT ADHESIVE AND ROOF CONSTRUCTION OBTAINED THEREBY

BACKGROUND OF THE INVENTION

The present invention relates generally to methods of roof construction, and more particularly relates to an improved method for adhering roof tiles to substrates using economical one-component adhesives, including one-component high-density polyurethane adhesive foams.

Roof construction, especially in residential construction, varies by location throughout the United States. In the northern climates, most roofs utilize a thin covering of tar paper-based shingles or thick wooden shingles as a final covering for the roof. In southern climates, tiles are used as the final covering of the roof. These roof tiles may be made from a variety of materials, including synthetic materials, such as plastics, and natural materials, such as stone, concrete, clay, ceramic and fired brick. In the application of these latter types of roof tiles, mortars or cementitious materials have been used in the past to apply the roof tiles to the roof substrate.

The use of mortars as roof tile adhesives is expensive because the mixing and application of the mortar is very labor intensive. Mortars are dense materials and their use as roof adhesives increases the load placed on the roof. The curing time for mortar may also be relatively long, thereby hampering quick completion of the roof. A need therefore exists for a lighter adhesive which is less labor intensive than mortar and which lends itself to efficient application of roof tiles.

Adhesives, and in particular adhesive foams, have been developed to replace mortars used in roof construction. U.S. Pat. No. 5,362,342, issued Nov. 8, 1994 describes the use of a two-component polyurethane foam to bond roof tiles to a substrate. This patent further describes the use of a bulky, complex pressurized dispensing system which is necessary to mix the two components together so that they may react to create a sufficient amount of foam with the desired adhesive characteristics. The aforesaid '342 patent further describes a particular method of using two-component foams to bond roof tiles to a roof substrate in which thick, linear beads of foam are applied to the entire length of the roof tiles.

One-component adhesives, such as those sold under the trade name INSTA-STIK by Insta-Foam of Joliet, Ill. have been utilized in the past, primarily for adhering roof insulation boards to roof substrates. These one-component adhesives are collapsible foams and are applied in long beads of foam for all or most of the entire length of the insulation boards to adhere the insulation boards to the roof. The use of long, linear beads of adhesives increases the cost of applications by using large amounts of adhesives and lengthening the application process.

The present invention is directed to a roof tile adhesion method which uses inexpensive one-component adhesives, and in a preferred embodiment one-component polyurethane adhesive foams, in a novel application pattern which significantly reduces the amount of adhesive used per roof tile without detracting from its adhesive strength.

It is therefore an object of the present invention to provide a method of adhering roof tiles to a roof substrate using economical one-component adhesives, including one-component adhesive foams.

Another object of the present invention is to provide a method for adhering roof tiles to a substrate using a modest amount of adhesive in a unique pattern which reduces the amount of adhesive used for application, yet provides sufficient adhesive strength between the roof tile and the substrate.

Yet another object of the present invention is to provide a method for adhering roof tiles to a substrate by applying a one-component, high-density polyurethane adhesive foam to opposing corners of the roof tile and placing the tiles into contact with the substrate, and letting the adhesive foam cure to adhere the roof tile to the substrate.

Still yet another object of the present invention is to provide an improved tiled roof construction having a substrate, a plurality of roof tiles adhered to the substrate, the roof tiles being adhered to the substrate by an adhesive deposited in alignment with opposing corners of the roof tiles, the adhesive deposits having a pad-like profile, the adhesive pads adhering opposite corners of the tile to the roof substrate and a preceding tile course, the adhesive pads further defining a discontinuous adhesive pattern which does not subdivide the space between the tile undersurfaces and the roof substrate into discrete spaces to restrict air circulation between the roof tile and the roof substrate.

SUMMARY OF THE INVENTION

In one principal aspect of the present invention, a roof construction method is provided in which successive courses of roof tile are adhered to a roof substrate by applying a one-component adhesive to the undersurface of the roof tiles; laying the tiles in successive courses on the roof; and, permitting the foam to cure.

In another principal aspect of the present invention and as exemplified in one preferred embodiment, a method for applying roof tiles to a roof substrate is provided which includes the steps of: providing a one-component adhesive, particularly a one-component adhesive foam; applying a first course of roof tile to a roof substrate by depositing the adhesive in a discontinuous pattern comprising two separate deposits in registration with opposite corners of the roof tiles; adhering the first course of roof tiles to the roof substrate by placing the first course of roof tiles onto the roof substrate to effect contact between the adhesive deposits, the roof tiles and the roof substrate; dispensing a series of second deposits of the adhesive in registration with opposite corners of the undersurfaces of a second course of roof tiles; placing the second course of roof tiles over the roof substrate and the first course of roof tiles such that the tail portions thereof and adhesive deposits aligned therewith contact the roof substrate and the head portions thereof and adhesive deposits aligned therewith overlie and contact the first course of roof tiles; and, permitting the adhesive to cure such that the first and second roof tile courses become adhered to roof substrate.

In another principal aspect of the present invention and as exemplified by another embodiment of the invention, a roof construction includes a roof substrate and a plurality of roof tiles attached to the substrate in successive courses, each of the tiles being attached to the roof substrate by discontinuous deposits of a one-component adhesive aligned with opposing corners of the undersurfaces of roof tiles, the adhesive foam deposits spacing the tiles partially away from the roof substrate so as to create an air channel therebetween.

These and other objects, features and advantages of the present invention will be apparent through a reading of the following detailed description, taken in conjunction with accompanying drawings, wherein like reference numerals refer to like parts.

BRIEF DESCRIPTION OF THE DRAWINGS

In the course of the description, reference will be made to the attached drawings in which.

DESCRIPTION OF THE PREFERRED EMBODIMENTS

Figure 1:
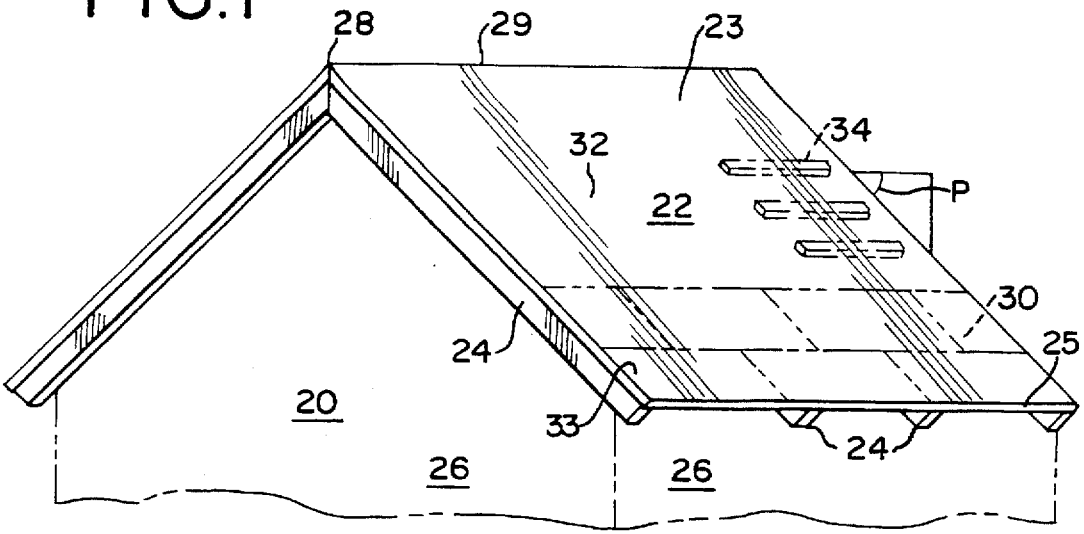
FIG. 1 illustrates a typical pitched roof upon which roof tiles are attached.

FIG. 1 illustrates a structure 20 having a roof 22 disposed thereon at a particular angle, or pitch P. The roof 22 includes a substrate 23 is supported on the structure 20 by a series of structural members, shown as roof joists 24 which are spaced apart from each other along the walls 26 of the structure. The roof joists 24 extend from the edge, or eave 25 of the roof upwardly at the pitch P and may be connected to a central ridge beam 28 at the apex 29 of the roof in a conventional manner.

The roof substrate 22 is commonly of a multiple layer construction and may include sheathing, or decking 30, in the form of plywood, particle board, cement boards or the like which is preferably fixed to the joists 24 such as by nailing. This sheathing 30 serves as a support surface for the final covering, or cap sheet, of the roof 22. This covering may be a water resistant material 32, such as roofing felt or tar paper and is commonly referred to in the art as an "underlayment". When circumstances dictate, such as when the pitch of the roof is steep, the substrate 20 may further include a series of spaced-apart batten strips 34 (shown in phantom) laterally applied to its surface to provide engagement points for anchor lugs formed in the roof tiles to engage in order to prevent movement of the roof tile during application to the substrate 22.

Figure 2:
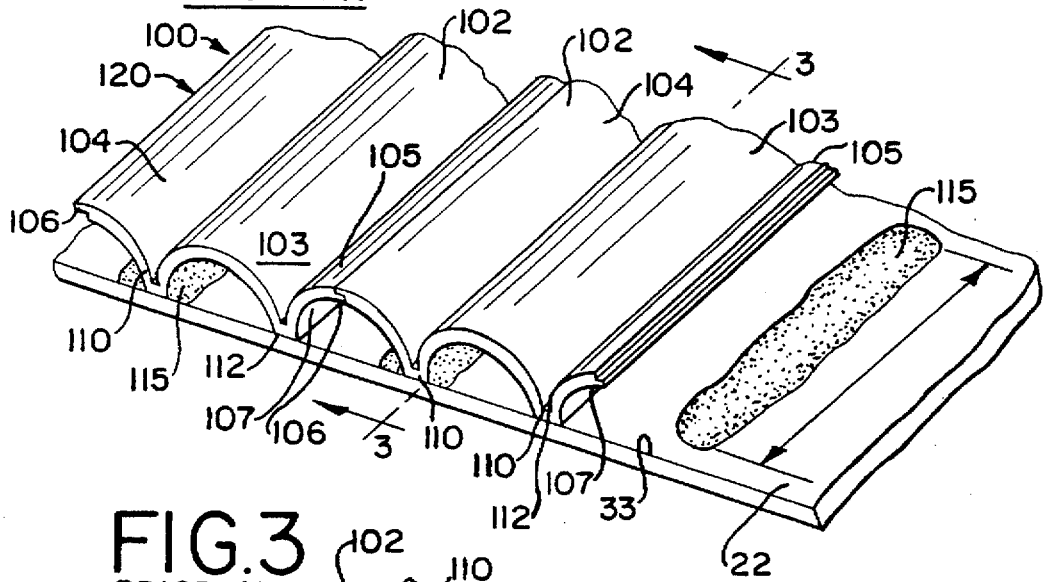
FIG.2 PRIOR ART
FIG. 2 is a perspective view of a segment of a prior art roof construction utilizing a two-component adhesive foam to adhere a roof tile course to a roof substrate using, continuous, linear beads of adhesive foam along the entire length of the roof tiles.
Figure 3:
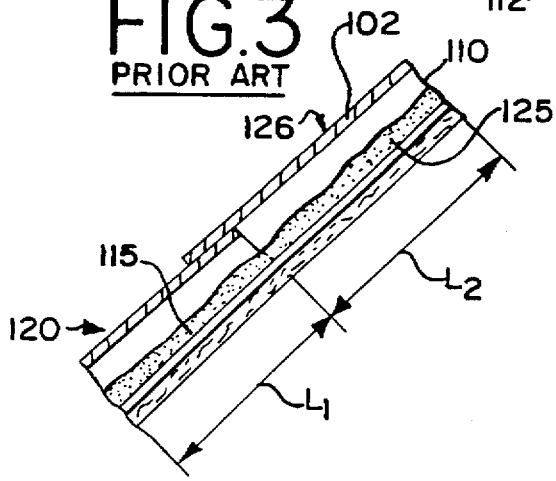
FIG.3 PRIOR ART
FIG. 3 is a sectional view of FIG. 2 taken along lines 3—3 thereof illustrating the longitudinal extent of the adhesive foam.

FIGS. 2 & 3 illustrate a prior art roof construction 100 which is typical of the construction described in U.S. Pat. No. 5,362,342, in which roof tiles 102 are adhered to a roof substrate 22. As described in the '342 patent, the construction 100 includes a plurality of low profile roofing tiles 102 having a Spanish-influenced design. Each roof tile 102 is rectangular in its exterior dimensions with a non-planar upper surface and has a hollow central semi-circular portion 103 flanked by two hollow quarter portions 104, 105 which include respective engagement edges 106, 107. The central semi-circular portion 103 and its flanking quarter portions 104, 105 meet together to define two support ribs 110 having a flat lower surface 112 which rest upon the exposed flat surface 33 of the roof 22.

As taught in the aforesaid '342 patent, a two-component foam is deposited onto the exterior surface 33 of the roof 22 in the form of a thick, linear bead '15 of foam. This thick bead 115 of adhesive foam extends for the entire length of the tiles 102. In the assembly of this type of roof construction, the foam bead 115 is used to apply a starter course 120 of roof tiles, and the length of the foam bead substantially matches the length $L_1$ of this first course 120 of tiles. Once the first course 120 has been applied, similar thick beads 125 having lengths $L_2$ which match the length of the second course 126 of tiles are applied to the roof substrate 23 and the first course 120 of tiles.

Although the use of the two-component foam 114 in this type of roof construction 100 is effective enough to adhere the roof tiles 102 in place upon the roof 22, such two-component foams are generally expensive. Furthermore, the teachings of the '342 patent direct one skilled in the art to apply an adhesive foam bead for the entire length or substantially the entire length of the tiles 116. This fashion of adhesive foam application promotes the use of more adhesive foam than necessary.

It has been discovered with the development of the present invention that a more economical one-component adhesive, including an adhesive foam, may be used to reliably adhere roof tiles to a roof substrate and in a particular pattern which uses significantly less adhesive than taught by the aforesaid '342 patent and other prior art roof-adhesive foam applications.

In an important aspect of the present invention, a one-component adhesive is utilized to adhere the roof tiles to the roof substrate. One advantage the use of one-component adhesives, especially one-component adhesive foams, have over two-components adhesive foams is cost. Another advantage is that one-component adhesives are dispensed from single pressurized containers, which avoids the use of maintaining separate adhesive foam components by the installer on site in inventory and the need for an elaborate and complex mixing, reacting and dispensing apparatus as are utilized with two-component adhesive foams an example of which is disclosed in the aforesaid '342 patent. Additionally, the methods of the present invention and, particularly the pattern used for the application of the adhesive, do not subdivide the undersurfaces of the roof tiles or the interstitial spaces between the undersurfaces and the roof substrate into discrete, areas which may inhibit the passage of air between the roof tile and the underlying roof substrate, and inhibit the opposing roof tile and substrate to grow and contract according to climatic conditions.

It has been found that the present invention significantly reduces the amount of adhesive needed to adhere a single roof tile to a roof substrate and further provides sufficient bonding strength to meet building code roof criteria. Table 1 which appears below in this detailed description, sets forth uplift test data for various profile roof tile using Tile Bond™ roof tile adhesive manufactured by Insta-Foam Products of Joliet, Ill. This data indicates that the novel adhesive application pattern produces a sufficient uplift strength.

In another important aspect of the present invention, the one-component adhesive foam is dispensed onto the roof substrate and roof tiles in a discontinuous pattern so that the adhesive foam does not substantially subdivide the undersurfaces of each roof tile into discrete areas to thereby partially cut off air circulation as can the continuous, linear deposits of adhesive foam described in the aforesaid '342 patent. The adhesive foam is further concentrated in deposits at opposing corners of the underside of the roof tile.

Figure 7:
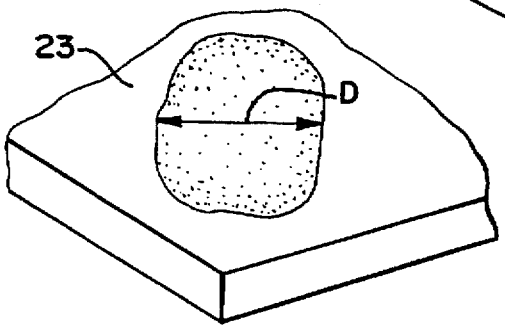
FIG. 7 is a view of a tennis-ball like adhesive deposit used in the present invention.
Figure 8:
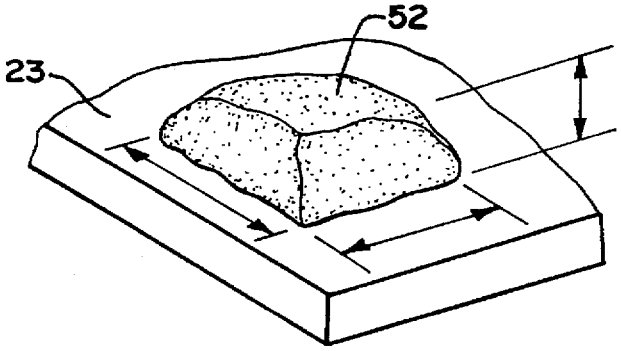
FIG. 8 is a view of a pad-like deposit of adhesive foam used in the present invention.

The adhesive deposits of the present invention shall be aptly characterized in this detailed description as "pads" or "pad-like" deposits because they may comprise circular or irregular shapes, rather than comprise continuous or linear, longitudinal beads. It has been found through testing, the results of which are set forth below, that such pads provide optimum adhesive strength as measured by uplift resistance force with minimal usage of the foam. The pads 50 may be generally circular in configuration and approximately the size of a tennis ball about 2½-inches in diameter D, such as is shown in FIG. 7. The adhesive pads may also have a generally rectangular pad-like configuration 52 of dimensions of about 1 inch high by 2 inches long by 3 inches wide as shown in FIG. 8. It shall be understood that the adhesive configurations illustrated in FIGS. 7 and 8 are merely exemplary of suitable deposits which have been demonstrated to provide the necessary uplift strength for use in roof tile attachment. Other discontinuous deposits may be utilized to achieve the same results.

It has also been noted that the use of these adhesive deposits in the particular pattern mentioned above not only reduces the amount of foam used, but also beneficially does not subdivide the undersurface of the roof tile and the interstitial space which occurs between the roof tile undersurfaces and the roof surface to restrict the passage of air therethrough in both the longitudinal and lateral directions ("X", "Y"). Rather the present invention does not impart any such restrictive subdivision and thereby facilitates air passage which permits the roof substrate and tile to expand and contact harmoniously in various climatic conditions.

Testing of one particular adhesive, Tile Bond™ roof tile adhesive manufactured by Insta-Foam Products of Joliet, Ill., was performed on various profile roof tiles to determine the static uplift strength and moment resistance of the adhesive pattern of the present invention. This testing was performed in accordance with the Dade County (Florida) Testing Protocol PA 101-95 (JAN) "Test Procedure for Static Uplift Resistance of Mortar or Adhesive Set Tile Systems". This Tile Bond™ adhesive in a one-component, high-density polyurethane adhesive foam. This type of foam is a minimal expanding foam and has a density which ranges from about 1½ pounds per cubic foot to about 4 pounds per cubic foot. The density of this adhesive foam is increased when the roof tile is passed into contact with it. Greater density foams may be used up to about 10 pounds per cubic foot.

The testing was performed on roof panels constructed in accordance with that described in the PA 101-95 test protocol. The roof panels had dimensions of around 4 by 8 feet upon which 14 test tiles were applied using the Insta-Foam Tile Bond™ roof tile adhesive foam described above. The test sections were constructed using nominal ½ inch plywood, American Plywood Association 32/16 sheathing having a thickness of 15/32 inches. The sheathing was nailed to 2-inch by 6-inch supports spaced at the perimeters of the sheathing and spaced on 24-inch centers in between. The nailing pattern was conventional using 8d (8-penny) common nails spaced on 6-inch centers along the perimeters of the panels and 12-inches within the panel.

An underlayment was applied to the sheathing after nailing which consisted of an ASTM D226, Type II anchor sheet with 12 gauge roofing nails and 1⅝-inch tin caps. The nailing pattern was a 12-inch grid pattern staggered in two rows of the roof panel field and 6-inch centers at any laps. An ASTM D249 mineral surface top ply sheet was attached to the anchor sheet by way of a coating of ASTM D312, Type IV asphalt and allowed to dry for 24 hours before the application of any tile systems. Thus underlayment is known in the art as a "standard 30/90" underlayment.

Two other underlayments were used in the tests. One underlayment consisted of a 40 mil thickness rubberized SBS modified asphalt sheet sold under the tradename Rainproof-40 by the Protectowrap Company. The other underlayment consisted of a standard two-ply 30 system using two layers of ASTM D226, Type II sheets and horizontal batten strips. These roofing sheets were lapped 19 inches over preceding sheets and mechanically attached to the roof sheathing using nails at 6-inch centers in rows of 18-inch centers.

A number of roof panels were constructed using the three types of underlayments described above and after the 24-hour period drying period, various profile roof tiles were attached in respective sets to each roof panel. A test hole was drilled in each of the test tiles of the panels and was located on the centerline of the roof tile at a distance of 0.76 times the length (i.e., 0.76×Length) of the tile from the head of the tile. A ¼-inch diameter concrete anchor screw was installed in this hole to provide a point on the roof tile to which a test load could be applied.

The tiles tested consisted of the second course of tiles, which were applied to a preceding roof tile course with a nominal 2-inch overlap. That is, the trailing edge of the roof tile was laid upon the leading edge of the preceding roof tile course. Fourteen test tiles were evaluated for each of Tests 1 through 4 on roof panels constructed using a standard 30/90 underlayment and twelve test tiles were evaluated for Tests 5 and 6 on roof panels using the rubberized SBS modified asphalt sheet and two-ply 30 system underlayments. Tile Bond™ adhesive was dispensed in a discontinuous pattern in registration with the opposite corners of the roof tiles.

Four different styles of roof tiles were tested from two different roof tile manufacturers. Those style tiles were the "Colonial", "Capri" and "Espana" styles manufactured by Lifetile and the "Villa" style tile manufactured by Monier. The adhesive dispenser was weighed after adhesive was applied to every 3 to 4 tiles in order to obtain an average value of the mass of adhesive used for each tile. The adhesive was allowed to cure overnight and then the roof tiles were tested to determine their uplift resistance.

A floor model Instron No. 1115 testing machine equipped with a 1000 lb load cell and chart recorder was used for testing the tiles. A chain was attached between the load cell of the Instron machine and the test screw of a particular tile. The roof panels were inclined at about 9.5° to emulate a roof pitch of 2:12, that is 2-inch rise for every 12-inch of horizontal extent. The test results are reproduced in Table 1 below:

TABLE 1

| TEST NUMBER & TILE STYLE | NUMBER OF TILES TESTED | TILE PROFILE | ROOF UNDERLAY-MENT | AVERAGE ADHESIVE AMOUNT (per tile) | AVERAGE ULTI-MATE LOAD (LBS) | MINIMUM RESIST-ANCE LOAD (LBS) | RESISTING MOVEMENT FT-LBS |
|---|---|---|---|---|---|---|---|
| 1-Colonial | 14 | Flat | 30/90 | 13.8 | 143.1 | 66.3 | 71.1 |
| 2-Capri | 14 | Low | 30/90 | 12.3 | 185.1 | 87.3 | 93.5 |
| 3-Espana | 14 | High | 30/90 | 9.8 | 131.8 | 60.2 | 65.0 |
| 4-Villa | 14 | Low | 30/90 | 14.2 | 223.3 | 107.0 | 111.2 |
| 5-Colonial | 12 | Flat | SBS Modified | 12.8 | 223.3 | 106.0 | 113.9 |
| 6-Colonial | 12 | Flat | 2-ply 30 with batten strips | 11.1 | 224.2 | 106.4 | 101.0 |

It can be seen from Table 1 that the average mass of adhesive used per tile varied between about 9 grams to about 15 grams (or about 4 grams to about 8 grams per adhesive deposit), yet the least minimum ultimate load obtained was about 130 lbs as reflected in Test 3. Other testing of one component adhesives using about 2 grams per desposit have yielded uplift failure values of about 100 pounds of force. Thus, it can be seen that the discontinuous pattern of the prsent invention provides sufficient uplift force resistance with a substantial reduction in foam amount.

Figure 4:
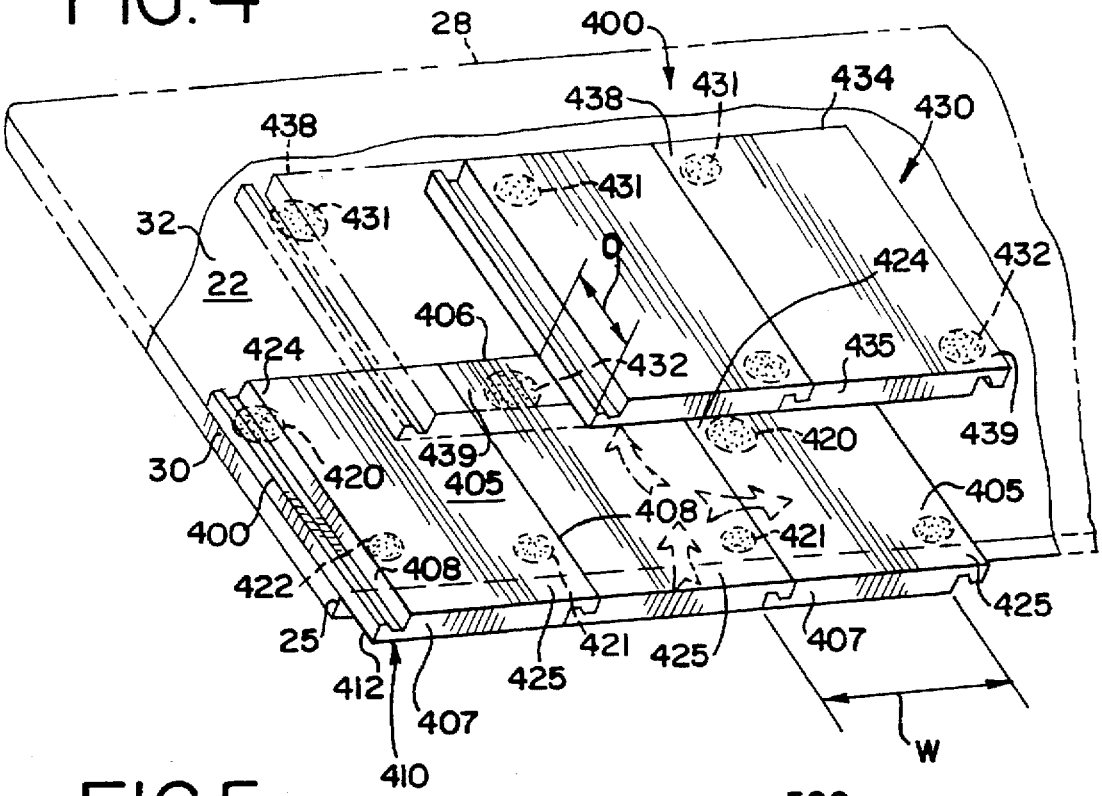
FIG. 4 is a perspective view of a section of a roof illustrating the placement of two courses of flat roof tiles installed thereon using the present invention.

Turning now to FIGS. 4–7, examples of various types of roof tiles and their adhesion to a roof using the present invention are illustrated. FIG. 4 illustrates a section 400 of a pitched roof using flat profile roof tiles similar in configuration to the "Colonial" tiles of Test 1 of Table 1. The roof substrate 22 is planar and includes support sheathing 30 covered by an underlayment 32. The roof section 400 depicted includes a lower eave 25 and the roof section 400 is angled upwardly at a preset pitch P up to a ridge 28 (shown in phantom).

In accordance with the present invention, a first set of roof tiles 405 is selected from a supply of tiles. The tiles 405 have opposing leading and trailing edges 406, 407 and side edges 408 which interconnect the leading and trailing edges 406, 407 together to define an overall rectangular configuration, the side edges 408 may include engagement members 410 as illustrated which permit the interconnection of adjacent ones of the first tiles 405. A discontinuous pattern of a one-component adhesive as previously described is used for attachment of these tiles 405 to the roof substrate 22. This pattern includes two separate adhesive deposits 420, 421 which are preferably aligned with each other near the opposite corners 424, 425 of the portions of the roof tiles 402 which oppose the roof 22 and near the leading and trailing edges 406, 407 thereof. The lower adhesive deposits 421 are positioned close to the eave 25 of the roof 400 on the first course tiles 405.

After the adhesive deposits 420, 421 are applied to either to the exterior surface 33 of the underlayment 32 or directly to the undersurfaces 412 of the first course tiles 405, the tiles 405 are placed onto the roof 400 so that contact is made between the adhesive deposits 420, 421, the roof tiles 405 and the roof underlayment 32. In this regard, the tiles 405 are preferably pushed down onto the adhesive deposits 420, 421 to effect a reliable contact with the underlayment 32. The adhesive deposits do not subdivide the interstitial spaces occurring between the roof tiles and the roof substrate into discrete areas such as is taught in the aforementioned U.S. Pat. No. 5,362,342 which division would restrict air and moisture flow therebetween. Rather, the adhesive deposits 420, 421 beneficially do not create any such subdivision so that the passage of air (and moisture) through the interstitial spaces is facilitated rather than inhibited as illustrated in the phantom arrows of FIG. 4. Flow of air and moisture through these interstitial areas 414 occurs as indicated by the arrows in FIGS. 4 & 8, and permits the roof substrate and tiles to expand and contract in accordance with climatic conditions.

A second set of roof tiles 430 is then selected and the discontinuous adhesive pattern is repeated. That is, two adhesive deposits 431, 432 are registered with the leading and trailing edges 434, 435 and opposite corners 438, 439 of a second course of tiles 430 in locations corresponding to the corner—corner arrangement illustrated in the upper left of FIG. 4. Once the adhesive is deposited (either on the tile themselves or the opposing roof or preceding tile surfaces), the second tiles 430 are positioned over the roof substrate 23 and the leading edges 406 of the first tiles 405 so that an overlap "O" occurs as illustrated as per the tile manufacturer's installation instructions. The second tiles 430 are then pressed down so that effective contact is made between their undersurfaces 433, the adhesive deposits 431, 432, and the roof substrate and first tile course overlap O. The second set 430 of tiles are further staggered, or offset, laterally a distance of approximately 50% of the width W of the tiles so that the interengaging side edges 436 of the tiles 430 are not aligned together in a line from the eave 25 of the roof up toward the ridge 28 of the roof 400.

In FIG. 4, it can also be seen that the first set of tiles 405 which are applied at the eave 25 of the roof 22 includes a portion 410 which overhangs the eave 25. The length of this overhang is commonly dictated by local building codes and a common overhang is in the order of 2 inches. Uplift forces may be exerted against these overhang portions 410 by high winds, and in order to provide an additional factor of safety for this first set of tiles 405 to counteract any such uplift forces, an additional adhesive deposit 422 may be applied in alignment with the remaining lower corner 426 of each of the tiles 405 of the first tile course near the trailing edges 407 thereof.

Figure 5:
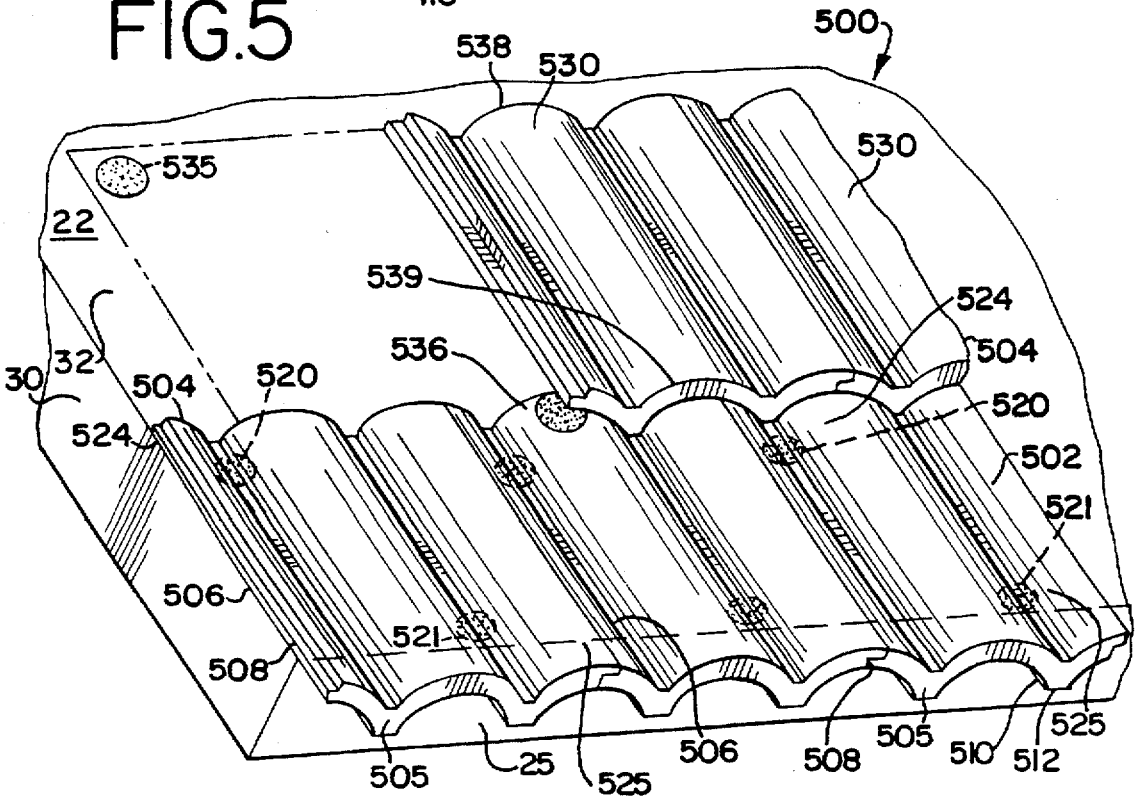
FIG. 5 is a perspective view of a section of a roof illustrating the placement of two courses of roof tiles installed using the present invention and used with low profile, non-planar roof tiles.

FIG. 5 illustrates another roof section 500 using a different profile tile. The tiles shown are a low profile tile similar to the "Capri" style tested in Test 2 of Table 1. The first course of tiles 502 have opposed leading and trailing edges 504, 505 and side edges 506 which interconnect the edges 504, 505. The side edges 506 include interlocking strips 508 which permit adjacent tiles to be interlocked together. The first tiles 502 further have a curved exterior configuration and in this regard, the undersurfaces 510 of the tiles 502 include ribs 512 which are intended to contact the roof substrate.

Utilizing the present invention, two adhesive deposits 520, 521 are positioned in a discontinuous pattern in alignment with and near the opposing corners 524, 525 and leading and trailing edges 504, 505 of the first tiles 502. The first tiles 502 are placed onto the substrate so that the adhesive deposits 520, 521 make effective contact between the substrate 23 and the tile undersurfaces 510. A second set of tiles 530 is selected and the adhesive is either applied to those tiles 530 or to the substrate 23 and to the overlap area 532 of the first tiles 502 in the discontinuous pattern of the invention, as exemplified by the two adhesive deposits 535, 536 shown exposed in the upper left of FIG. 5. The second tiles 530 are then applied onto the adhesive deposits 535, 536 so that the leading edges 538 of the tiles 530 oppose the roof substrate and the trailing edges 539 thereof oppose the first tiles 502.

Figure 6:
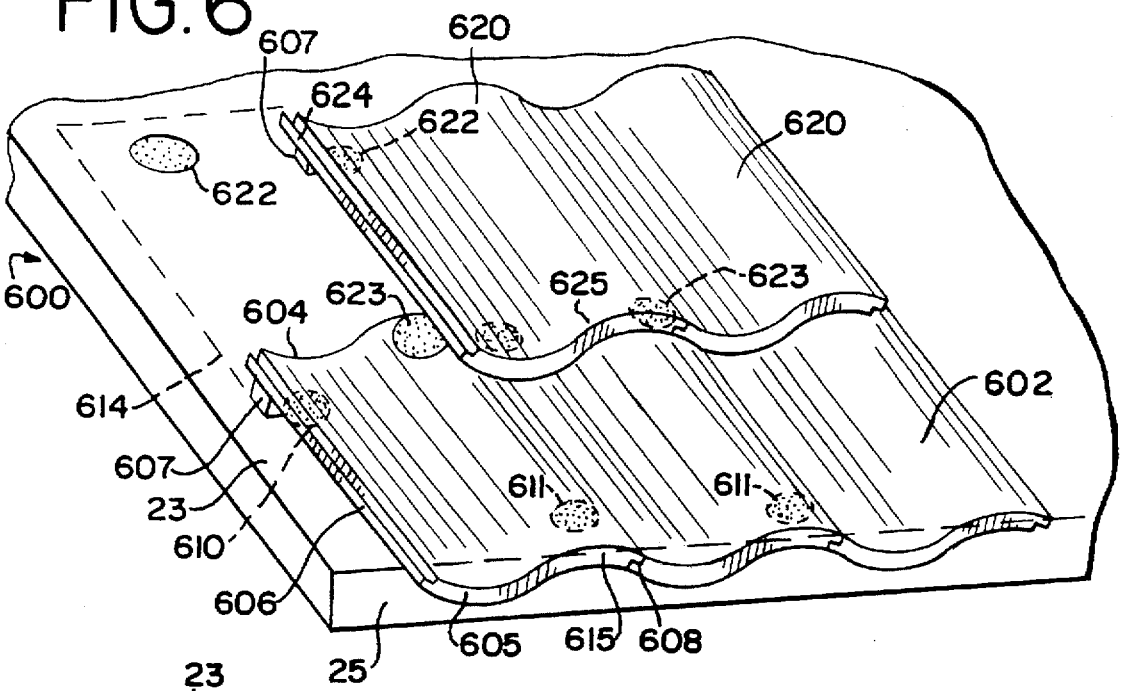
FIG. 6 is a perspective view of a section of a roof illustrating the placement of two courses of roof tiles installed thereon using the present invention as used with S-shaped, high profile roof tiles.
Figure 9:
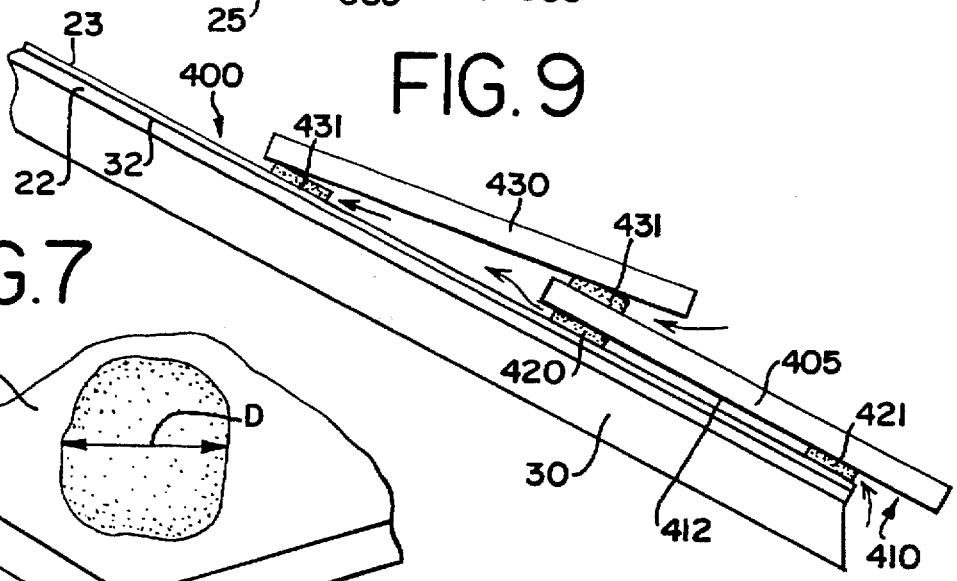
FIG. 9 is a cross-sectional view of FIG. 1.

FIG. 6 illustrates another roof section 600 with a plurality of high profile S-shaped roof tiles similar in style to the "Espana" tiles tested in Test 3 of Table 1. The roof section 600 includes a first set of tiles 602 which have a non-planar configuration and S-shaped profile when viewed from either the leading edge 604 or trailing edge 606 of the tiles 602. Side edges 606 interconnect the leading and trailing edges 604, 605 and preferably include engagement strips 608 disposed therealong. The first tiles 602 are applied to the roof substrate 23 near the eave 25 of the roof 600 by first applying a one-component adhesive in the corner—corner discontinuous pattern of the invention as described above. The tiles 602 illustrated typically may also include anchor lugs 607 formed on their undersurfaces to assist in retention of the tiles 602 on steeply pitched roofs. These anchor lugs 607 will typically engage a batten strip 34. The adhesive deposits 610, 611 in this type application are preferably made in alignment with the opposite corners 614, 615 of the tiles 602 to the extent that they oppose the roof 22 and make contact on the upper end with the anchor lugs 607 and batten strips 34.

A second set of tiles 620 is selected and two additional adhesive deposits 622, 623 are applied in alignment with opposite corners 624, 625 of the tiles 620. As shown in FIG. 6, the adhesive deposits 624, 625 may be applied to the head lap portion of a lower, adjoining first tile 602 and to the roof substrate 23, and the tile is then positioned so that it contacts the adhesive pads 624, 625.

It will be appreciated that the method of applying roof tiles, as described hereinabove, increases the efficiency and reduces the cost for the installation of tile roofs. No complex two-component adhesive foam pressurized supply is needed, and significantly less amounts of foam are used in the application, leading to material cost savings. Additionally, the corner-corner pattern creates unimpeded air channel between the undersurfaces of the tiles and the roof substrate.

It will be appreciated that the embodiments of the present invention which have been discussed are merely illustrative of some of the applications of this invention and that numerous modifications may be made by those skilled in the art without departing from the true spirit and scope of this invention. For example, the adhesive deposits may, in some application, take the form of beads applied in alignment with the leading and trailing edges of the tiles provided they do not subdivide the interstitial areas into discrete subareas. The deposits may also resemble mounds or piles.

We claim:

1. A method for installing roof tiles onto a roof comprising the steps of:

providing a supply of a one-component adhesive foam;

providing a supply of roof tiles for attachment to said roof, each of the roof tiles having opposing leading and trailing edges interconnected by side edges, each of said roof tiles having an undersurface which opposes said roof when installed thereon;

choosing a set of first roof tiles from said roof tile supply;

dispensing a first discontinuous pattern of adhesive foam from said adhesive foam supply, the first discontinuous pattern including two separate deposits of said adhesive foam generally aligned with and proximate to the leading and trailing edges of each of said first roof tiles;

placing said first roof tiles onto said roof so that said trailing edges of said first roof tiles are positioned closer to an eave of said roof than said first roof tiles leading edges and laying said first roof tiles onto said roof so that contact is effected between said first discontinuous pattern adhesive foam deposits, said roof and said first roof tiles;

choosing a set of second roof tiles from said roof tile supply;

dispensing a second discontinuous pattern of said adhesive foam from said adhesive foam supply, said second discontinuous pattern including two separate adhesive foam deposits generally aligned with and proximate to leading and trailing edges of each of said second roof tiles;

placing said second roof tiles onto said roof so that said trailing edges of said second roof tiles are positioned over said leading edges of said first roof tiles and said leading edges of said second roof tiles are positioned over said roof and laying said second roof tiles onto said roof and said first roof tiles so that contact is effected between said second discontinuous pattern adhesive foam deposits, said second roof tiles, first roof tiles and said roof;

choosing a set of subsequent roof tiles from said roof tile supply;

dispensing said adhesive foam in a subsequent discontinuous pattern, said subsequent discontinuous pattern including two separate adhesive foam deposits generally aligned with and proximate to leading and trailing edges of said subsequent roof tiles;

placing said subsequent roof tiles onto said roof so that leading edges of said subsequent roof tiles are positioned over said roof and trailing edges of said subsequent roof tile are positioned over a preceding set of roof tiles and laying said subsequent tiles onto said roof so that contact is effected between said subsequent discontinuous pattern adhesive foam deposits, said roof and said preceding roof tile set; and, allowing said first, second and subsequent discontinuous patterns to cure to bond said first,second and subsequent roof tiles to said roof.

2. The method as set forth in claim 1, wherein said adhesive foam has a density of between about 1½ pounds per cubic foot and about 4 pounds per cubic foot.

3. The method as set forth in claim 1, wherein said separate adhesive deposits of said second and subsequent discontinuous patterns are positioned in registration with opposing corners of said sets of roof tiles.

4. The method as set forth in claim 1, wherein said adhesive deposits have the approximate dimensions of a tennis ball.

5. The method as set forth in claim 4, wherein said adhesive deposits are approximately 2½ inches in diameter.

6. The method as set forth in claim 1, wherein said adhesive deposits of said first, second and subsequent discontinuous patterns have a pad-like configuration having approximate dimensions of about 1 inch by about 2 inches by about 3 inches.

7. The method as set forth in claim 1, wherein each of said adhesive deposits contain about 4½ grams to about 7½ grams of said adhesive foam.

8. The method as set forth in claim 1, wherein each of said roof tiles applied to said roof have a total combined mass of adhesive foam applied thereto of between about 9 grams to about 15 grams.

9. The method as set forth in claim 1, wherein said adhesive foam is a one-component high-density polyurethane adhesive foam.

10. The method as set forth in claim 1, wherein said roof tiles include anchor lugs depending from said undersurfaces, and said method further includes the steps of:

applying batten strips to said roof;

and, engaging said batten strips with said roof tile anchor lugs.

11. The method as set forth in claim 10, further including the step of contacting some of said adhesive deposits of said sets of roof tiles to said batten strips.

12. The method as set forth in claim 1, wherein said roof tiles have engagement members formed along their side edges.

13. The method as set forth in claim 1, wherein said roof tiles include flat profile tiles with a generally flat top surface.

14. The method as set forth in claim 1, wherein said roof tiles include low profile tiles with curved top surfaces.

15. The method as set forth in claim 1, wherein said roof tiles include high profile tiles with curved top surfaces.

16. The method as set forth in claim 1, wherein said roof tiles are high profile tiles having a general S-shape when viewed from either of said leading or trailing edges thereof.

17. The method as set forth in claim 1, wherein said adhesive foam has a density of between about 1½ pounds per cubic foot and about 10 pounds per cubic foot.

18. The method as set forth in claim 1, wherein said first, second and subsequent adhesive foam deposits are respectively dispensed in said respective discontinuous first, second and subsequent patterns onto said undersurfaces of said first, second and subsequent roof tiles.

19. The method as set forth in claim 1, wherein said first adhesive foam deposits are dispensed in said first discontinuous pattern onto said roof substrate.

20. The method as set forth in claim 1, wherein said second adhesive foam deposits are dispensed in said second discontinuous pattern onto said roof substrate and said first roof tiles.

21. A method of installing roof tiles onto a roof substrate, the roof substrate having at least one eave at a lower end thereof and a ridge at one upper end thereof, said roof substrate having an underlayment disposed thereon, the method comprising the steps of:

providing a one-component adhesive supply;

providing a supply of roof tiles, each roof tile having an undersurface, an upper surface, and opposing leading and trailing edges and opposing marginal side edge interconnecting said leading and trailing edges;

separating sets of first and second roof tiles from said roof tile supply;

dispensing a first discontinuous pattern of said adhesive in alignment with opposing corners of said first roof tiles near said leading and trailing edges of said first roof tiles;

positioning said first roof tiles over said substrate so that said leading edges of said first roof tiles are spaced a distance from said roof eave which is greater than a distance of said trailing edges of said first roof tiles from said roof eave and pressing said first roof tiles into place so that contact is made between said first discontinuous pattern of adhesive, said undersurfaces of said first roof tiles and said underlayment;

dispensing a second discontinuous pattern of said adhesive in alignment with opposing corners of said second roof tiles near said leading and trailing edges of said second roof tiles;

positioning said second roof tiles over said substrate and said first set of tiles so that said leading edges of said second roof tiles oppose said underlayment and said trailing edges of said second roof tiles oppose said first roof tiles and pressing said second roof tiles into place so that contact is made between said second discontinuous adhesive pattern, said underlayment, said first roof tiles and second roof tiles; and allowing said first and second discontinuous adhesive patterns to permanently cure.

22. The method of claim 21, wherein said roof tiles include engagement members disposed along said marginal side edges thereof.

23. The method of claim 22, further including the step of engaging said roof tile engagement members of adjacent roof tiles together.

24. The method of claim 21, wherein said adhesive deposits have the approximate shape of a tennis ball with an approximate diameter of 2½ inches.

25. The method of claim 21, wherein said adhesive deposits have pad-like configurations with dimensions of approximately 1 inch by 2 inches by 3 inches.

26. The method of claim 21, wherein said adhesive is a one-component, polyurethane, moisture-cured foam with a density of between about 1½ lbs/ft$^3$ and about 4 lbs/ft$^3$.

27. The method of claim 21, further including the step of applying said two separate adhesive deposits of said first and second discontinuous adhesive patterns to said undersurfaces of said first and second roof tiles.

28. The method of claim 21, wherein said adhesive deposits applied to each of said roof tiles have a total combined mass of between about 9 grams and about 15 grams.

29. The method of claim 27, wherein said two separate adhesive deposits of said first and second discontinuous adhesive patterns are applied to said first and second roof tile undersurfaces proximate to said opposing marginal side edges of said first and second roof tiles.

30. A method for applying roof tiles to a roof substrate, comprising the steps of: providing a supply of one-component adhesive foam; applying two separate adhesive foam deposits in a diagonal pattern on the underside of a first course of roof tiles; placing the first course of roof tiles onto the roof substrate in order to effect contact between the adhesive foam deposits on said first course of roof tiles and said roof substrate; applying two separate foam deposits in said diagonal pattern onto the underside of a second course of roof tiles; placing the second course of roof tiles onto both said roof substrate and said first course of roof tiles in order to effect contact between the adhesive foam deposits on said second course of roof tiles and said roof substrate and first course of roof tiles; and, permitting said adhesive foam deposits to permanently cure such that the first course of roof tiles become adhered to roof substrate and said second course of roof tiles become adhered to said roof substrate and said first course of roof tiles.

31. The method according to claim 30, wherein said two adhesive foam deposits deposited in each of said roof tiles of said second course are generally aligned with opposing corners of said roof tiles of said second course.

32. The method according to claim 30, wherein said adhesive foam deposits applied to each of said first and second course of roof tiles have a total combined mass of between about 9 grams and about 15 grams.

33. A method of installing roof tiles onto a roof substrate, the roof substrate having at least one eave at a lower end thereof and a ridge at one upper end thereof, the method comprising the steps of:

providing a one-component adhesive foam supply;

providing a supply of roof tiles, each roof tile having an undersurface, an upper surface, and opposing leading and trailing edges and opposing marginal side edge interconnecting said leading and trailing edges;

separating sets of first and second roof tiles from said roof tile supply;

dispensing a first discontinuous adhesive foam pattern proximate to said opposing marginal edges of said first roof tiles, said first discontinuous adhesive foam pattern including two adhesive foam deposits diagonally offset from each other;

positioning said first roof tiles over said substrate and placing said first roof tiles onto said roof substrate so that contact is made between said first adhesive foam discontinuous pattern, said undersurfaces of said first roof tiles and said roof substrate;

dispensing a second discontinuous adhesive foam pattern proximate to opposing marginal edges of said second roof tiles, said second discontinuous adhesive foam pattern including two adhesive foam deposits diagonally offset from each other;

positioning said second roof tiles over said roof substrate and said first set of tiles so that said leading edges of said second roof tiles oppose said underlayment and said trailing edges of said second roof tiles oppose said first roof tiles and pressing said second roof tiles into place so that contact is made between said second discontinuous adhesive pattern, said roof substrate, said first roof tiles and second roof tiles; and allowing said first and second discontinuous adhesive foam patterns to permanently cure.

34. The method according to claim 33, wherein said adhesive deposits applied to each of said roof tiles have a total combined mass of between about 9 grams and about 15 grams.

35. A method for installing roof tiles onto a roof comprising the steps of:

providing a supply of a one-component adhesive foam;

providing a supply of roof tiles for attachment to said roof, each of the roof tiles having opposing leading and trailing edges interconnected by opposing marginal side edges, each of said roof tiles having an undersurface which opposes said roof when installed thereon;

choosing a set of first roof tiles from said roof tile supply;

dispensing a first discontinuous pattern of adhesive foam from said adhesive foam supply, the first discontinuous pattern including two separate deposits of said adhesive foam generally aligned with and proximate to the leading and trailing edges of each of said first roof tiles;

placing said first roof tiles onto said roof so that said trailing edges of said first roof tiles are positioned closer to an eave of said roof than said first roof tiles leading edges and laying said first roof tiles onto said roof so that contact is effected between said first discontinuous pattern adhesive foam deposits, said roof and said first roof tiles;

choosing a set of second roof tiles from said roof tile supply;

dispensing a second discontinuous pattern of said adhesive foam from said adhesive foam supply, said second discontinuous pattern including two separate adhesive foam deposits generally aligned with and proximate to leading and trailing edges of each of said second roof tiles;

placing said second roof tiles onto said roof so that said trailing edges of said second roof tiles are positioned over said leading edges of said first roof tiles and said leading edges of said second roof tiles are positioned over said roof and laying said second roof tiles onto said roof and said first roof tiles so that contact is effected between said second discontinuous pattern adhesive foam deposits, said second roof tiles, first roof tiles and said roof;

choosing a set of subsequent roof tiles from said roof tile supply;

dispensing said adhesive foam in a subsequent discontinuous pattern, said subsequent discontinuous pattern including two separate adhesive foam deposits generally aligned with and proximate to leading and trailing edges of said subsequent roof tiles;

placing said subsequent roof tiles onto said roof so that leading edges of said subsequent roof tiles are positioned over said roof and trailing edges of said subsequent roof tile are positioned over a preceding set of roof tiles and laying said subsequent tiles onto said roof so that contact is effected between said subsequent discontinuous pattern adhesive foam deposits, said roof and said preceding roof tile set; and, allowing said first, second and subsequent discontinuous patterns to cure to bond said first,second and subsequent roof tiles to said roof, said adhesive deposits of said first, second and subsequent discontinuous adhesive patterns having dimensions such that they do not completely extend between said opposing marginal side edges of said first, second and subsequent roof tiles so as to block passage of air between said first, second and subsequent roof tiles and said roof.

* * * * *